US006942743B2

(12) United States Patent
Rink et al.

(10) Patent No.: US 6,942,743 B2
(45) Date of Patent: Sep. 13, 2005

(54) FLUID EXTRACTION FOR AIRBAG INFLATORS

(75) Inventors: Karl K. Rink, Liberty, UT (US); Anthony M. Young, Brigham City, UT (US); David J. Green, Brigham City, UT (US)

(73) Assignee: Autoliv ASP, Inc., Ogden, UT (US)

( * ) Notice: Subject to any disclaimer, the term of this patent is extended or adjusted under 35 U.S.C. 154(b) by 713 days.

(21) Appl. No.: 09/932,672

(22) Filed: Aug. 17, 2001

(65) Prior Publication Data

US 2003/0042719 A1 Mar. 6, 2003

(51) Int. Cl.[7] ..... C06B 45/00; C06B 47/04
(52) U.S. Cl. ..... 149/1; 149/74; 102/530
(58) Field of Search ..... 102/530, 531; 149/1, 74, 109.6

(56) References Cited

U.S. PATENT DOCUMENTS

| | | | |
|---|---|---|---|
| 5,669,629 | A | 9/1997 | Rink |
| 5,713,595 | A | 2/1998 | Mooney et al. |
| 5,884,938 | A | 3/1999 | Rink et al. |
| 5,941,562 | A | 8/1999 | Rink et al. |
| 6,238,500 | B1 | 5/2001 | Blomquist |
| 6,244,623 | B1 | 6/2001 | Moore et al. |

FOREIGN PATENT DOCUMENTS

| | | |
|---|---|---|
| DE | 43 03 169 | 4/1994 |
| DE | 196 21 045 | 11/1997 |
| DE | 199 07 241 | 8/2000 |
| EP | 742 125 | 11/1996 |
| EP | 776 800 | 6/1997 |
| WO | 99/32334 | 7/1999 |

OTHER PUBLICATIONS

K.D. Bartle et al.: *Solubilities of Solids and Liquids of Low Volatility in Supercritical Carbon Dioxide; J. Phys. Chem. Ref. Data*, vol. 20, No. 4, 713–756, 1991.

*Primary Examiner*—Aileen Felton
(74) *Attorney, Agent, or Firm*—Sally J. Brown

(57) ABSTRACT

Inflation apparatuses and methods are provided wherein a hydrocarbon-containing inflation gas-producing mixture is formed via the fluid extraction of the hydrocarbon from a substrate material.

43 Claims, 6 Drawing Sheets

FLUID EXTRACTION FOR AIRBAG INFLATORS

BACKGROUND OF THE INVENTION

This invention relates generally to gas generation and, more particularly, to methods for producing or forming gas producing reactions mixtures in or for airbag inflator devices as well as the inflator devices so produced.

It is well known to protect a vehicle occupant using a cushion or bag, e.g., an "airbag cushion," that is inflated or expanded with gas such as when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as an "inflator."

Many types of inflator devices have been disclosed in the art for the inflating of one or more inflatable restraint system airbag cushions. Known types of inflator devices include inflators known as "blow down" inflators and "reverse flow" inflators. In a blow down inflation system, a pyrotechnic or other selected material is commonly burned to create a build-up of pressure within a compressed gas storage chamber such as to result in the rupture or release of inflation gas therefrom when the internal pressure reaches a predetermined level or range. Thus, in blow down inflator devices, the opening or rupture of a seal, burst disk or the like within the inflator typically results or produces a flow of heated or elevated temperature inflation gas from the device and into an associated airbag cushion. While blow down inflation systems can desirably be of relatively lower cost and complexity, such systems can result in the delivery of inflation gas to an associated airbag cushion at a higher temperature, pressure and/or mass flow rate than may otherwise be desired.

In "reverse flow" inflator devices, the actuating initiator and the openings wherethrough the inflation gas exits from the inflator device are typically at or along the same end or side of the inflator device. Thus, in typical reverse flow inflators, the initial inflation gas exiting from the inflator device and into an associated airbag cushion is relatively cool and is later followed by heated or elevated temperature inflation gas. Consequently, reverse flow inflators which initially provide or supply a relatively cool inflation gas, followed by heated or elevated temperature inflation gas to an associated airbag cushion, can typically more easily provide or result in the more gradual deployment of the associated airbag cushion, as may be desired in particular deployment applications.

Various of such prior art inflator devices rely on the reaction of a fuel with an oxidant to produce or form a gaseous inflation medium. In addition, as disclosed in commonly assigned, Rink, U.S. Pat. No. 5,669,629, issued Sep. 23, 1997, whose disclosure is hereby incorporated by reference, it has been proposed various dissociation or decomposition sensitizer materials can be added or included with a dissociative or decomposable gas source material, such as nitrous oxide, such as to promote or accelerate the rate of the dissociation or decomposition reaction of the gas source material. As disclosed, such sensitizer materials are preferably added or included in an amount below the flammability limits for the content mix, such that the contents are preferably at an equivalence ratio of less than 0.25, preferably less than 0.15. At such low relative amounts, the contents are essentially non-flammable and thus combustion and the formation of combustion products are practically avoided.

While the separate storage or containment of fluid oxidant materials from such fuel or hydrocarbon or hydrocarbon derivative sensitizer may reduce or minimize at least some of the risks or dangers associated with the use of such material combinations, such separate storage or containment can undesirably increase the costs and complexity associated with manufacture and production as well as increase the complexity of operation such as may impair performance reliability. Further, inflator devices which rely on the reaction of a fuel with a fluid oxidant generally exhibit improved performance, as evidenced by increased efficiency, when such fuel and fluid oxidant are in a well mixed form. In view thereof, the use of co-existing mixtures of various hydrocarbon fuels and a selected oxidant has been proposed. Unfortunately, the manufacture of inflators using such premixed fuel and fluid oxidant mixtures can be problematic. For example, welding, such as may be desired in various inflator designs, can be dangerous when done in the presence of a volatile mixture of fuel and oxidant.

One approach that has been applied in an effort to reduce or minimize the risks or dangers associated with the use of premixed fuel and fluid oxidant mixtures has been to rely on mixtures of fuel and oxidant, which mixtures are very fuel lean. While fuel lean mixtures may reduce some of the risks or hazzards associated with using fuel-oxidant mixtures, such use typically does not eliminate the risks associated with such mixtures and may create or compound other problems or complications. For example, the use of very fuel lean mixtures can lead to performance and ignition problems or complications.

Thus, while premixed combinations of fuel, particularly hydrocarbon fuels, and oxidants can generally greatly enhance performance, such oxidant and fuel mixtures or combinations have been difficult to either or both prepare and manufacture. In view thereof, there is a need and a demand for methods which more easily permit the formation and use of mixtures of fuel and oxidant in a device as well as improved inflator devices having or which contain such fuel and oxidant mixtures.

SUMMARY OF THE INVENTION

A general object of the invention is to provide an improved method for forming a mixture of fuel and fluid oxidant in an inflator device as well as an improved inflator device having or being able to form or provide such a mixture of fuel and oxidant.

A more specific objective of the invention is to overcome one or more of the problems described above.

The general object of the invention can be attained, at least in part, through a method involving contacting a hydrocarbon-containing solid substrate material with an extraction fluid at conditions whereat the extraction fluid has a reduced density of at least 0.2 and a reduced density of no more than 2.0 wherein at least a portion of the hydrocarbon contained in the solid material is extracted into the extraction fluid to form an inflation gas-producing mixture.

The prior art generally fails to provide a method for preparing and introducing a fluid mixture of fuel and oxidant into an inflator device which method is one or more as simple, easy, or safe to practice as may be desired. Further, the prior art generally fails to provide inflator devices wherein such fuel and oxidant mixtures can desirably be formed in situ and thus desirably avoid at least some of the risks or dangers associated with the preparation, incorporation and use of such mixtures in inflator devices.

The invention further comprehends a method for the in situ formation of an inflation gas-producing mixture. In accordance with one preferred embodiment of the invention, such method involves contacting a hydrocarbon-containing substrate material with an extraction fluid containing at least one extraction medium selected from the group consisting of nitrous oxide, carbon dioxide, and mixtures thereof and at conditions whereat the extraction fluid has a reduced density of at least 0.2 and a reduced density of no more than 2.0 wherein at least a portion of the hydrocarbon contained in the solid material is extracted into the extraction fluid to form the inflation gas-producing mixture.

The invention still further comprehends an inflation gas-providing device wherein a mixture including a hydrocarbon material and an oxygen-containing material react to provide inflation gas. In accordance with one preferred embodiment of the invention, such device includes a chamber having contents including a hydrocarbon-containing solid substrate material and an extraction fluid at conditions whereat the extraction fluid has a reduced density of at least 0.2 and a reduced density of no more than 2.0 and wherein at least a portion of the hydrocarbon contained in the substrate material is extracted into the extraction fluid to form an inflation gas-producing mixture.

As used herein, references to "combustion," "combustion reactions" and the like are to be understood to generally refer to the exothermic reaction of a fuel with an oxidant.

As used herein, references to "dissociation," "dissociation reactions" and the like are to be understood to refer to the dissociation, splitting, decomposition or fragmentation of a single molecular species into two or more entities.

"Thermal dissociation" is a dissociation controlled primarily by temperature. It will be appreciated that while pressure may, in a complex manner, also influence a thermal dissociation such as perhaps by changing the threshold temperature required for the dissociation reaction to initiate or, for example, at a higher operating pressure change the energy which may be required for the dissociation reaction to be completed, such dissociation reactions remain primarily temperature controlled.

An "exothermic thermal dissociation" is a thermal dissociation which liberates heat.

"Equivalence ratio" ($\phi$) is an expression commonly used in reference to combustion and combustion-related processes. Equivalence ratio is defined as the ratio of the actual fuel to oxidant ratio $(F/O)_A$ divided by the stoichiometric fuel to oxidant ratio $(F/O)_S$:

$$\phi=(F/O)_A/(F/O)_S \quad (1)$$

(A stoichiometric reaction is a unique reaction defined as one in which all the reactants are consumed and converted to products in their most stable form. For example, in the combustion of a hydrocarbon fuel with oxygen, a stoichiometric reaction is one in which the reactants are entirely consumed and converted to products entirely constituting carbon dioxide ($CO_2$) and water vapor ($H_2O$). Conversely, a reaction involving identical reactants is not stoichiometric if any carbon monoxide (CO) is present in the products because CO may react with $O_2$ to form $CO_2$, which is considered a more stable product than CO.)

For given temperature and pressure conditions, fuel and oxidant mixtures are flammable over only a specific range of equivalence ratios. Mixtures with an equivalence ratio of less than 0.25 are herein considered nonflammable, with the associated reaction being a decomposition reaction or, more specifically, a dissociative reaction, as opposed to a combustion reaction.

References to the detection or sensing of "occupant presence" are to be understood to refer to and include detection and/or sensing of size, weight, and/or position of an occupant under consideration.

References to inflator or inflation gas "output" are to be understood to refer to inflator performance output parameters such as the quantity, supply, and rate of supply of inflation gas. With "adaptive output inflators," the inflator output is generally dependent on selected operating conditions such as ambient temperature, occupant presence, seat belt usage and rate of deceleration of the motor vehicle, for example.

A "pyrotechnic" material, in its simplest form, consists of an oxidizing agent and a fuel that produce an exothermic, self-sustaining reaction when heated to the ignition temperature thereof.

Other objects and advantages will be apparent to those skilled in the art from the following detailed description taken in conjunction with the appended claims and drawings.

DETAILED DESCRIPTION OF THE INVENTION

Figure 1:
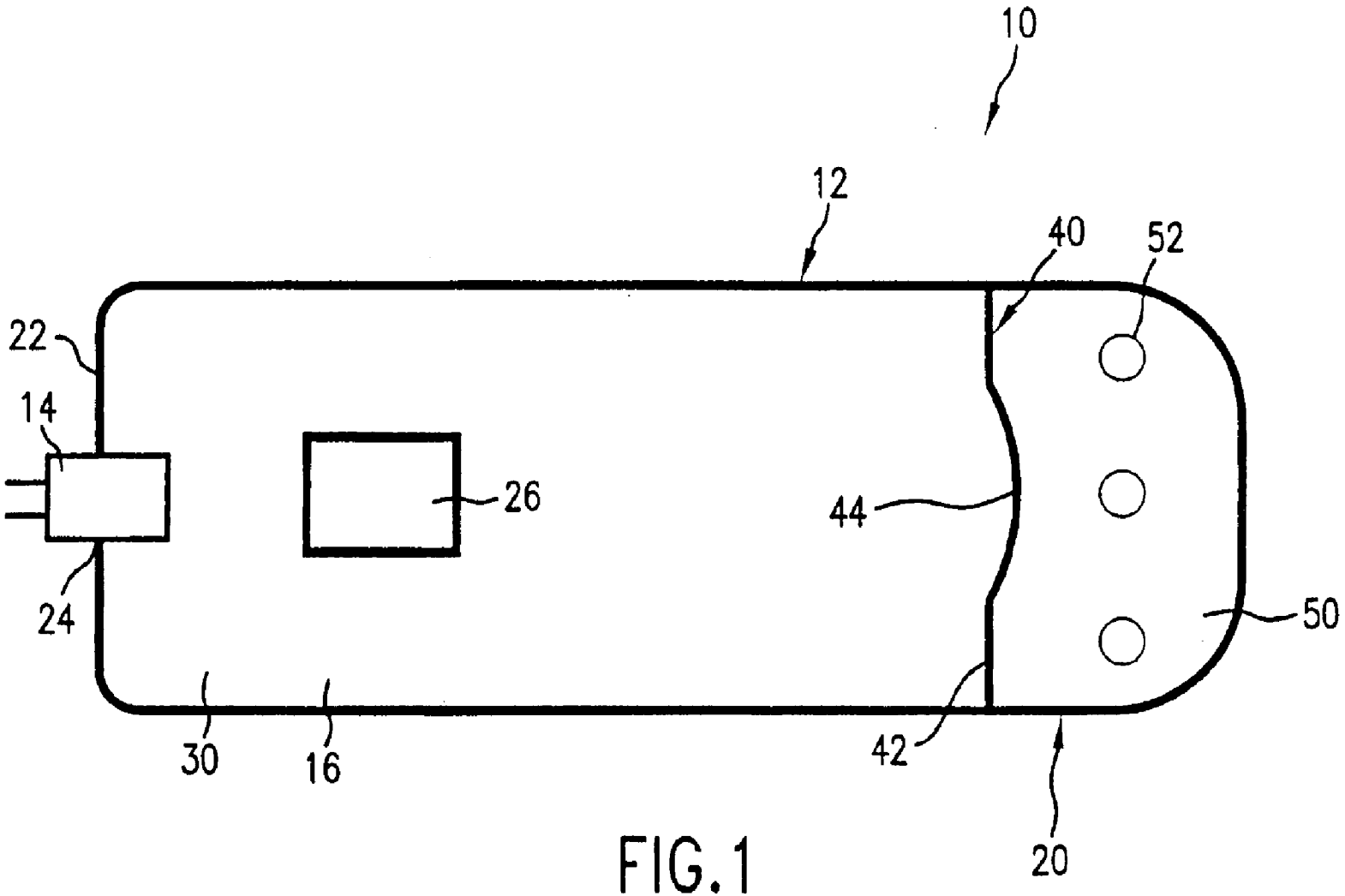
FIG. 1 is a simplified, partially in section, schematic drawing of an airbag inflator in accordance with one embodiment of the invention.

The present invention provides, as detailed below, an improved apparatus for inflating an inflatable device and which apparatus stores or contains a selected hydrocarbon material in a fluid medium. Also provided are improved methods whereby such hydrocarbon material in a fluid medium can be obtained. The invention may be embodied in a variety of different structures. Referring initially to FIG. 1, there is illustrated an apparatus for inflating an inflatable device, also sometimes referred to hereinafter as an "inflator" or "airbag inflator assembly", generally designated by the reference numeral 10, in accordance with one preferred embodiment of the invention and such as may be used to inflate an inflatable vehicle occupant restraint, e.g., an inflatable airbag cushion, (not shown). As is known and upon proper actuation, such inflatable vehicle occupant restraints are typically inflated by a flow of an inflation fluid, e.g., gas, from an inflator assembly to restrain movement of an occupant of the vehicle. In practice, it is common that the inflatable vehicle occupant restraints be designed to inflate into a location within the vehicle between the occupant and certain parts of the vehicle interior, such as the doors, steering wheel, instrument panel or the like, to prevent or avoid the occupant from forcibly striking such parts of the vehicle interior.

The invention is described hereinafter with particular reference to an inflator for use in various automotive vehicles including vans, pick-up trucks, and particularly automobiles. As will be appreciated by those skilled in the art, the invention has applicability to various types or kinds of inflation applications such as airbag installations for automotive vehicles including driver side, passenger side and side impact airbag assemblies, for example. Moreover, the invention has applicability with other types of vehicles as well, including airplanes, for example.

The inflator 10 is an assembly that comprises a pressure vessel 12. The inflator assembly 10 includes an initiator device 14, a first chamber 16, and a diffuser assembly 20. The inflator 10 also includes a first end wall 22 and the end wall 22 has an opening 24 therein. In the inflator assembly 10, the initiator device 12 is desirably attached through the opening 24 in sealing relation, such as via a weld, crimp or other suitable hermetic seal.

In such an assembly, the initiator device 14 can include any suitable type of initiator means including: bridgewire, spark-discharge, heated or exploding wire or foil, through bulkhead (e.g., an initiator that discharges through a bulkhead such as in the form of a metal hermetic seal), for example, and may, if desired, optionally contain a desired load of a pyrotechnic charge. As will be appreciated, in certain preferred embodiments of the invention, the exclusion or minimization of such pyrotechnic material may be desired or required in certain application such as so minimize or avoid particulate formation or introduction into the inflation fluid of the inflator device. As will be described in greater detail below, the inclusion or presence of such pyrotechnic material may, however, be desired in certain alternative preferred embodiments of the invention such as to more easily or readily provide a large heat input for associated reaction processing. In view thereof, as pyrotechnic charge-containing initiators can typically more easily produce such relatively large heat inputs from a relatively small sized initiator device, the practice of the invention with such initiators can be particularly advantageous. An initiator may provide such a large heat input through the inclusion therewith or therein of an additional quantity of pyrotechnic, i.e., a "booster charge," such as boron potassium nitrate ($BKNO_3$), for example.

The first chamber 16 is situated adjacent the initiator device 14, with the initiator device 14 in discharge communication therewith. In the illustrated static or at rest condition or state, the first chamber 16 is closed. As described in greater detail below, the first chamber 16 contains a solid material, designated by the reference numeral 26. The first chamber 16 also has fluid contents, designated by the reference numeral 30, and such as may desirably be in contact with the solid material 26.

As described in greater detail below, such fluid contents can be stored in a gaseous, liquid, multi-component and/or multi-phase form (i.e., partially gaseous and partially liquid mixture), as may be desired in particular applications or installations. However, in view of a general preference for smaller sized airbag inflators and the fact that the density of such contents are generally significantly greater when in a liquid, rather than gaseous form, a preferred embodiment of the invention involves the use or incorporation of such contents primarily in a liquid form.

The first chamber 16 is closed and the fluid contents 30 thereof appropriately held therewithin from fluid communication with the diffuser assembly 20 by means of a closure 40 such as composed of a wall 42 with a burst or rupture disk 44. Those skilled in the art and guided by the teachings herein provided will appreciate that closures of other suitable types or forms can desirably be used in the practice of the invention and the broader practice of the invention is not necessarily limited to particular or specific types or forms of closures.

The diffuser assembly 20 defines a diffuser chamber 50 and includes a plurality of diffuser orifices or outlet openings 52 for dispensing inflation gas from the inflator 10 into an associated inflatable airbag cushion (not shown).

As identified above, the invention provides an improved apparatus for inflating an inflatable device and which apparatus stores or contains a selected hydrocarbon material in a fluid medium, as well as associated methods. In accordance therewith, in the inflator assembly 10, the solid material 26 is desirably a hydrocarbon-containing solid material. In view thereof, the solid material 26 is sometimes referred to hereinafter as a "substrate." The first chamber contents 30 include and, in accordance with a preferred embodiment of the invention, consist essentially of an extraction fluid effective for extraction of at least certain desired hydrocarbon materials from the solid substrate material.

Through or at least in part as a result of such extraction of one or more hydrocarbon materials by the extraction fluid, an inflation gas-producing mixture is formed or produced within the first chamber 16. In accordance with a preferred embodiment of the invention, the extracted hydrocarbon desirably forms a miscible combination with the extraction fluid. As will be appreciated by those skilled in the art and guided by the teachings herein provided, the conditions within inflators, in accordance with at least certain preferred embodiments of the invention, during either or both the manufacture and storage of such inflator devices are desirably conducive to extraction of the hydrocarbon from the substrate via the extraction fluid. In particular, inflators in accordance with the invention wherein the extraction fluid is nitrous oxide, carbon dioxide or a combination thereof will, during the manufacture and/or storage process, typically pass through the critical temperature of such materials such as under conditions where such materials exhibit comparatively strong extraction capabilities.

As detailed herein, inflation gas-producing mixtures formed in accordance with the invention can, in accordance with certain preferred embodiments of the invention, be of a composition suited for producing or forming inflation gas via dissociative processing. Those skilled in the art and guided by the teaching herein provided will appreciate that such inflation gas-producing mixtures will generally have equivalence ratios of less than 0.25.

In accordance with other preferred embodiments of the invention, the inflation gas-producing mixture is of a composition suited for producing or forming inflation gas via combustion processing. In such embodiments the inflation gas-producing mixture desirably has an equivalence ratio of at least 0.25 and no more than 1.4 and, in accordance with certain preferred embodiments of the invention will have an equivalence ratio of at least 0.4 and no more than 0.7.

In operation such as upon the sensing of the occurrence of a collision, an electrical signal is sent to the initiator device 14. The initiator device 14 functions and when it is a pyrotechnic-containing initiator, discharges high temperature combustion products into the first chamber 16 and specifically into contact with the inflation gas-producing mixture formed therein through extraction, into the extraction fluid formed by the chamber contents 30, of at least a portion of the hydrocarbon contained in the solid material 26.

Such initiator discharge is effective to cause or result in reaction, as detailed below, of at least a portion of the inflation gas-producing mixture formed within the first chamber 16 such as to produce or otherwise form an inflation gas medium. Thus, the pressure within the first chamber 16 is increased due to either or both the pressure impulse resulting from the firing of the initiator device 14 and the increase in temperature and pressure resulting from reaction of the inflation gas-producing mixture.

When the gas pressure within the first chamber 16 exceeds the structural capability of the burst disk 44, the disk ruptures or otherwise permits the passage of inflation gas into the diffuser chamber 50 and thus allows this inflation gas to exit through the diffuser orifices or outlet openings 52 into an associated airbag assembly.

The invention provides a method for producing or forming a hydrocarbon-containing inflation gas-producing mixture. In accordance with the broader practice of the invention, various hydrocarbon materials can be selected for extraction from a substrate material such as to form or result in various selected gas-producing mixtures. Preferred hydrocarbon and hydrocarbon derivative materials useable in the practice of the invention include paraffins, olefins, cycloparaffins, alcohols, esters, ethers and mixtures or combinations thereof. Ethylene is thought to be a particularly preferred hydrocarbon for use in the practice of the invention as ethylene can desirably form an azeotropic mixture with nitrous oxide and carbon dioxide.

As will be appreciated by those guided by the teachings herein provided, hydrocarbon-containing inflation gas-producing mixtures produced or formed in accordance with the invention may be used to produce inflation gas in accordance with various techniques.

For example, in accordance with certain preferred embodiments of the invention, such hydrocarbon-containing inflation gas-producing mixtures can desirably produce or supply inflation gas via a combustion process such as wherein the hydrocarbon in the mixture reacts with one or more oxidant materials such as also contained within such mixture to produce or form additional gaseous reaction products. Suitable oxidant or oxidant containing materials for use in the practice of such embodiment may include molecular oxygen, nitrous oxide, carbon dioxide and mixtures thereof, for example.

In accordance with certain other preferred embodiments of the invention, such hydrocarbon-containing inflation gas-producing mixtures can desirably produce or supply inflation gas via a dissociative process. For example, commonly assigned Rink, U.S. Pat. No. 5,669,629, issued 23 Sep. 1997; Rink et al., U.S. Pat. No. 5,884,938, issued 23 Mar. 1999; and Rink et al., U.S. Pat. No. 5,941,562, issued 24 Aug. 1999, the disclosures of which patents are hereby and expressly incorporated herein in their entirety, disclose that certain gas source materials which undergo dissociative or decompositional reactions, preferably an exothermic such reaction, to form gaseous products. As identified above, fuel and oxidant mixtures with an equivalence ratio of less than 0.25 are herein considered nonflammable, with the associated reaction being a decomposition reaction or, more specifically, a dissociative reaction, as opposed to a combustion reaction. A particularly preferred dissociative material for use in the practice of the invention is nitrous oxide. Such nitrous oxide dissociative material can desirably be used alone or in combination with one or more dissociation reaction modifiers. In accordance with one preferred embodiment of such aspect of the invention and as discussed further below, a particularly preferred dissociation reaction modifier for use in the practice of the invention is carbon dioxide.

Suitable substrate materials for initially containing such hydrocarbons include polymers and copolymers of various organic compounds such as those of synthesized compounds such as aldehydes, ethers, esters, vinyls and amides, for example, as well as, and probably to a lesser extent, naturally occurring compounds such as celluloses, saccharides and polysaccharides, for example. Particularly preferred are those of such solid substrate materials having expanded or porous, low-density forms such as in the nature of foams or sponges. Specific examples of such materials useful in the practice of the invention include polyurethane, polystyrene, polypropylene, polyethylene, polyester and polyamides. Other suitable substrate materials can include dienes, including butadienne, as well as various natural and synthetic rubber compounds and elastomers including neoprene, polyisoprene and copolymers of butadiene and styrene (SBR), for example. A particularly preferred class or family of substrate materials useful in the practice of the invention include polysiloxanes.

Further, those skilled in the art and guided by the teachings herein provided will appreciate that suitable substrate materials can be selected such that such solid material is totally or substantially consumed during operation of the inflator device such as may be desired to simplify one or more of the manufacture, construction, production or disposal of such inflator devices, as with such total or substantial combustion, no significant remainder or residue of the solid will remain within the used inflator device. It will generally be appreciated, however, that due to factors such as the stringent effluent requirements normally applicable for airbag inflation mediums, the incorporation and use of a substrate material which is at least in part consumed during operation may be problematic.

As detailed below, various extraction fluids can be desirably used in the practice of the invention. In accordance with a preferred embodiment of the invention, extraction fluids utilized in the practice of the invention desirably apply or take advantage of supercritical or near supercritical extraction techniques. In particular, it has been found advantageous that during such extraction process the extraction fluid have a reduced density of at least 0.2 and no more than 2.0 and, preferably, a reduced density of at least 0.8 and no more than 1.7, where:

$$\rho_r=\rho/\rho_c \tag{2}$$

where, $\rho_r$=reduced density
$\rho_c$=critical density of carbon dioxide
$\rho$=actual density at 21° C.

For particular extraction fluids or extraction fluid combinations, practice of the invention employing even more specific reduced densities may be desirable or preferred. For example, for systems employing extraction fluids comprising nitrous oxide and/or carbon dioxide in combination with significant quantities of other gases (e.g., helium) a reduced density of at least 1.0 and no more than 1.2 will generally be preferred. For systems containing only oxygen and carbon dioxide (e.g., no helium), a reduced density of at least 1.1 and no more than 1.5 will generally be preferred. For those preferred embodiment systems in accordance with the invention which contain only nitrous oxide and carbon dioxide (e.g., no helium), a reduced density of at least 1.2 and no more than 1.6 will generally be preferred Further, during such extraction process the extraction fluid desirably will have a reduced temperature of at least 0.50 and no more than 2.0, preferably a reduced temperature of at least 0.75 and no more than 1.25 and, more preferably, a reduced temperature of at least 1.0 and no more than 1.15, where:

$$T_r = T/T_c \quad (3)$$

where, $T_r$=reduced temperature
$T_c$=critical temperature
T=ambient temperature.

Suitable extraction fluids include extraction mediums selected from the group consisting of nitrous oxide, carbon dioxide, $SF_6$, xenon, ammonia and mixtures thereof. In accordance with certain preferred embodiments of the invention for airbag inflation applications, the extraction fluids are or include nitrous oxide ($N_2O$) and carbon dioxide ($CO_2$) either alone or in combination, with those extraction fluid mixtures or combinations containing 5 to 90% $N_2O$ and 10 to 95% $C_2O$ being preferred; those extraction fluid mixtures or combinations containing 10 to 75% $N_2O$ and 25 to 90% $CO_2$ being more preferred; and those extraction fluid mixtures or combinations containing 15 to 60% $N_2O$ and 40 to 85% $C_2O$ being even more preferred, where such percentages are on a molar basis and where such preferred mixtures or combinations have been identified based on knowledge of inflator performance parameters such as relating to rise rates, internal pressures and inflation gas exit temperatures. For example, those inflators which contain mixtures which include less than preferred relative amounts of nitrous oxide may not be able to realize various of the benefits of nitrous oxide dissociation to an extent sufficient to impact inflator performance in an optimal manner. Further, those inflators which contain mixtures which include more or a greater than preferred relative amount of nitrous oxide may experience sufficiently aggressive performance as to make temperature control more difficult than desired or preferred.

In certain embodiments, an extraction fluid comprising the extraction medium carbon dioxide and containing or including added molecular oxygen has been found desirable and useful. In accordance with certain of such preferred embodiments, the extraction fluid will consist essentially of carbon dioxide and between 5 to 50 molar % $O_2$, more preferably between 10 to 30 molar % $O_2$ and, even more preferably, between 15 to 25 molar % $O_2$, where such values and ranges are again based on knowledge of inflator performance parameters such as relating to rise rates, internal pressures and inflation gas exit temperatures.

It is to be understood that extraction fluids in accordance with the invention (such as those containing or consisting essentially of nitrous oxide, for example) can be stored in a gaseous, liquid or multi-phase form (i.e., partially gaseous and partially liquid mixture), as may be desired in particular applications or installations. However, in view of a general preference for smaller sized airbag inflators and the fact that the density of nitrous oxide is significantly greater when in a liquid, rather than gaseous form, one preferred embodiment of the invention involves the inflator use or incorporation of such nitrous oxide primarily in a liquid form.

As will be appreciated by those skilled in the art and guided by the teachings herein provided, the invention can desirably be practiced with various placements of a hydrocarbon-containing substrate within an inflator device in accordance with the invention. In general, it is believed desirable that the hydrocarbon-containing solid material be placed in the inflator chamber in such a way that, to the extent possible or practical, the surface area of the hydrocarbon-containing substrate which is in contact with the extraction fluid be increased or maximized. Thus, in accordance with certain preferred embodiments of the invention, the hydrocarbon-containing solid substrate material is placed in the inflator chamber such as to be at least substantially or practically surrounded by the extraction fluid. Further, in those embodiments wherein the substrate is neither totally nor substantially consumed upon operation, it may be preferred to position or place the solid material within the inflator device in a manner or fashion such as to avoid or minimize the possibility that such substrate material could exit the inflator during or upon operation. Thus, it may be desirable that the substrate be placed or positioned within the inflator device in or at a location either or both remote from the exits or at a location or position characterized by obstructions or other features such as reduce or minimize the flow velocity coming into contact therewith during operation of the inflator. Still further, as identified above, it may generally be desirable to avoid total or partial consumption, e.g., combustion reaction, of the substrate such as to avoid possible complications due to effluents resulting from such consumption reaction. Thus, it may be preferred to position or place the substrate within the inflator assembly at a location or position whereat consumption or burning of the substrate can practically be avoided or minimized, as will be apparent to those skilled in the art and guided by the teachings herein provided.

Those skilled in the art will further appreciate that even though the invention has been described above making specific reference to the extraction of a hydrocarbon by or via the extraction fluid, the invention can be advantageously applied to extract other materials such as may bind, combine or otherwise join or attach with such extracted hydrocarbons. For example, as described in the above-identified patent, Rink et al., U.S. Pat. No. 5,884,938, issued 23 Mar. 1999, many if not most carbon-bearing materials have been found to excellent adsorbers or "holders" of radioactive isotope leak trace materials, such as $Kr^{85}$, the use of which radioactive isotope leak trace materials is described in great detail therein. Thus, in accordance with certain preferred embodiments of the invention, the invention can be practiced to permit or otherwise facilitate or simplify the introduction of such leak trace materials within a closed inflator device chamber. In particular, the contacting of a hydrocarbon-containing solid material with an extraction fluid in accordance with the invention may desirably additionally result in extraction from the substrate material of at least a leak detection quantity of $Kr^{85}$ by the extraction fluid.

Figure 2:
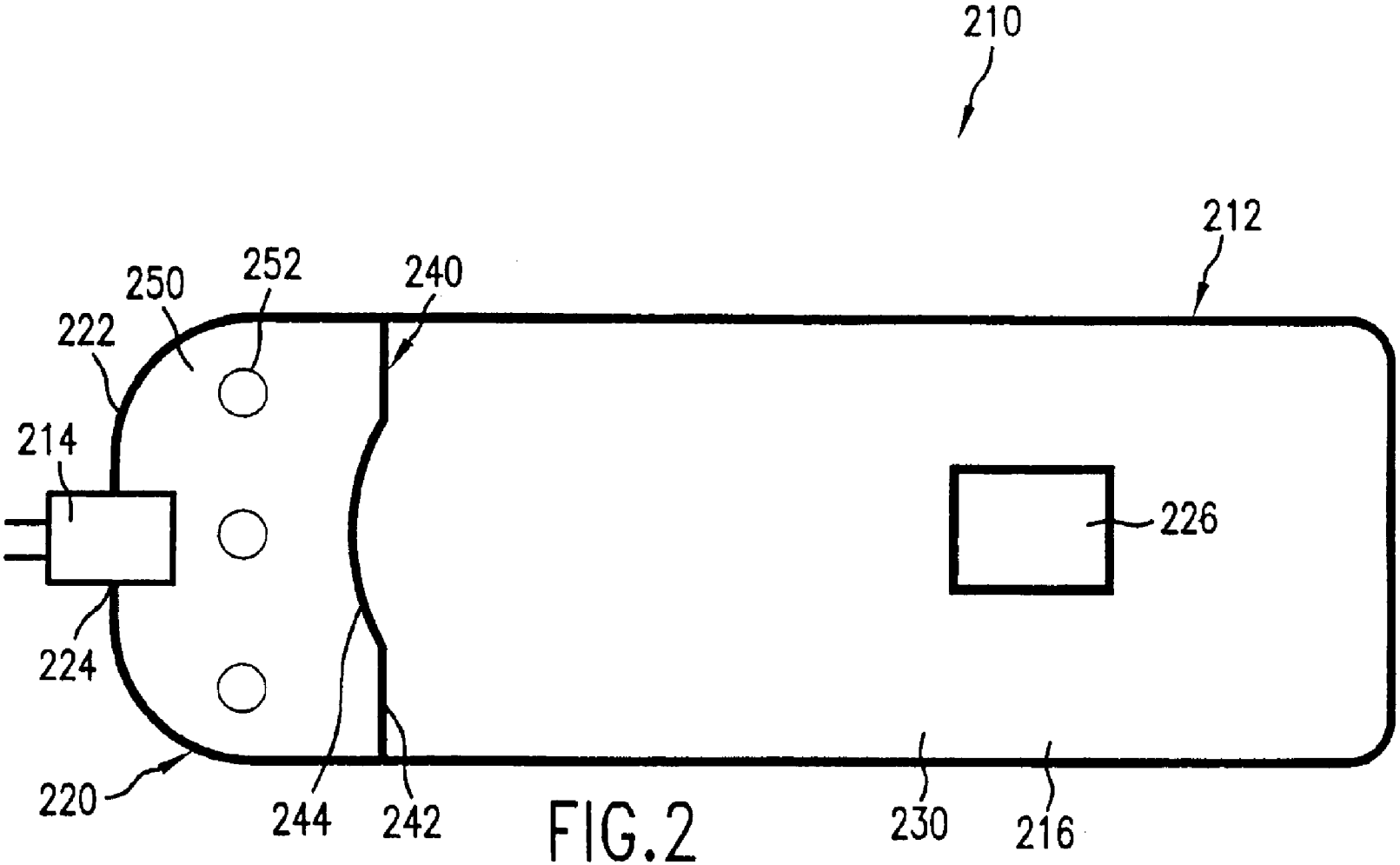
FIG. 2 is a simplified, partially in section, schematic drawing of an airbag inflator in accordance with an alternative embodiment of the invention.

While the invention has been described above making reference to the inflator 10 shown in FIG. 1 and which inflator is of the general type described above as a blow down inflator, those skilled in the art and guided by the teachings herein provided will appropriate that the broader practice of the invention is not necessarily so limited. That is, the invention can be practice in conjunction with various types and forms of inflator devices wherein a hydrocarbon-containing inflation gas-producing mixture is desired or used. For example, FIG. 2 illustrates a reverse flow inflator assembly in general accord with the invention and generally designated by the reference numeral 210.

The inflator 210 is an assembly that comprises a pressure vessel 212. The inflator assembly 210 includes an initiator device 214, such as described above, a first chamber 216, and a diffuser assembly 220. The inflator 210 also includes a first end wall 222 that has an opening 224 therein wherethrough the initiator device 214 is desirably attached. In the illustrated static or at rest condition or state, the first chamber 216 is closed. Similar to the inflator 10 described above, the first chamber 216 contains a solid material, designated by the reference numeral 226, and has fluid contents, designated by the reference numeral 230, and such as may desirably be in contact with the solid material 226.

The first chamber 216 is closed and the fluid contents 230 thereof appropriately held therewithin from fluid communication with the diffuser assembly 220 by means of a closure 240 such as composed of a wall 242 with a burst or rupture disk 244. The diffuser assembly 220 defines a diffuser chamber 250 and includes a plurality of diffuser orifices or outlet openings 252 for dispensing inflation gas from the inflator 210 into an associated inflatable airbag cushion (not shown).

As will be appreciated, a significant difference between the inflator 10 and the inflator 210 is that in inflator 210 the first chamber 216, rather than being situated adjacent the initiator device 214, is spaced thereapart by the width of the diffuser chamber 250. The effect or consequence of such difference may more easily be appreciated through a discussion of the operation of the inflator assembly 210.

Operation

In operation, such as upon the sensing of a collision, an electrical signal is sent to the initiator device 214. The initiator device functions such as to initiate reaction of at least a portion of the pyrotechnic load therein contained such as to result in the rupture or otherwise opening of the burst disk 244. As a result, high temperature combustion products are discharged from the initiator 214 into the chamber 216 resulting in the heating and, in some cases, reaction of the contents therein contained, as described above. The opening of the burst disk 244 also permits the passage of at least a portion of the contents thereof into the diffuser assembly 220 and subsequently through the outlet openings 252 into an associated airbag assembly.

Figure 3:
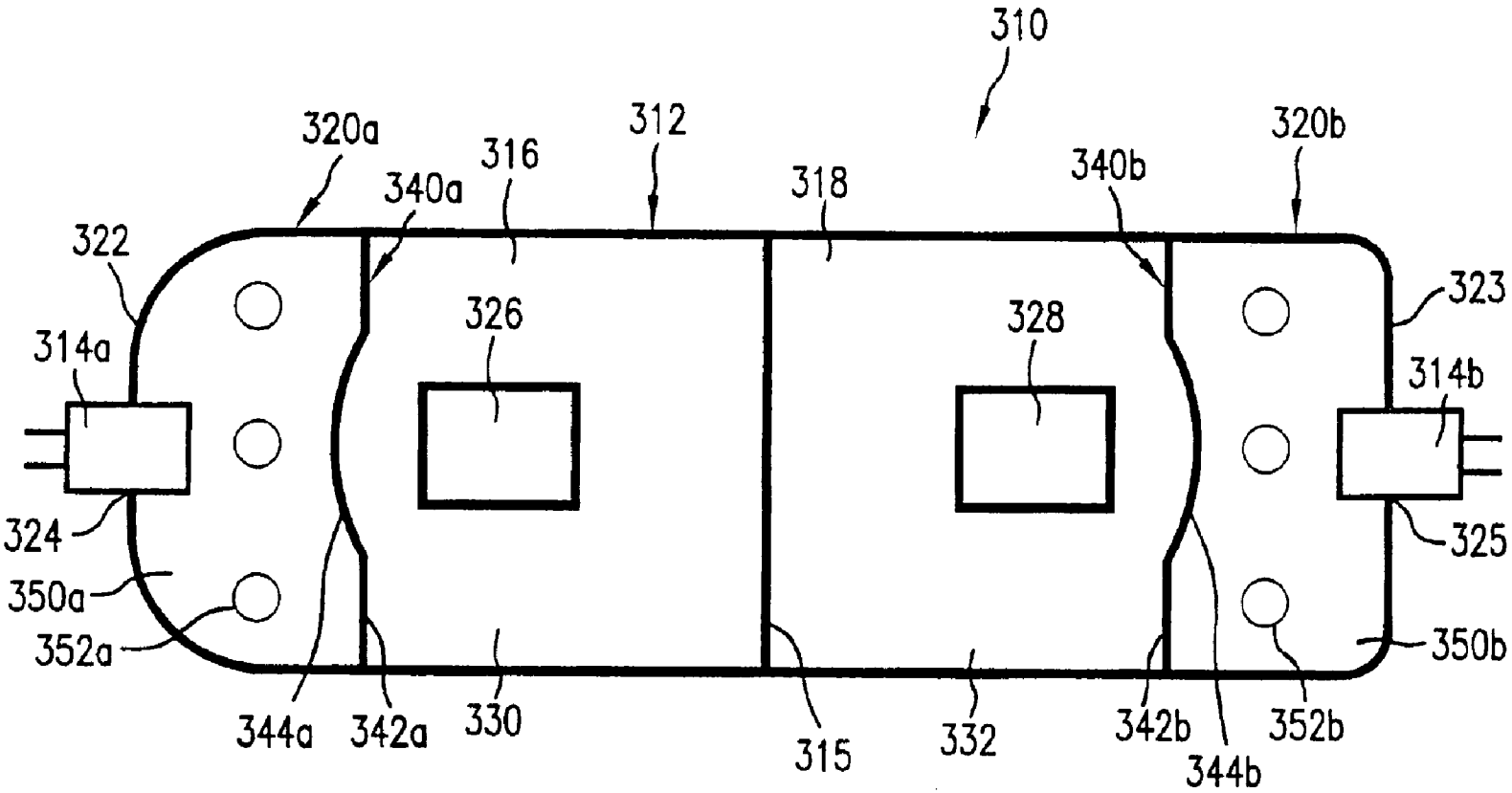
FIG. 3 is a simplified, partially in section, schematic drawing of an airbag inflator in accordance with another alternative embodiment of the invention.
Figure 4:
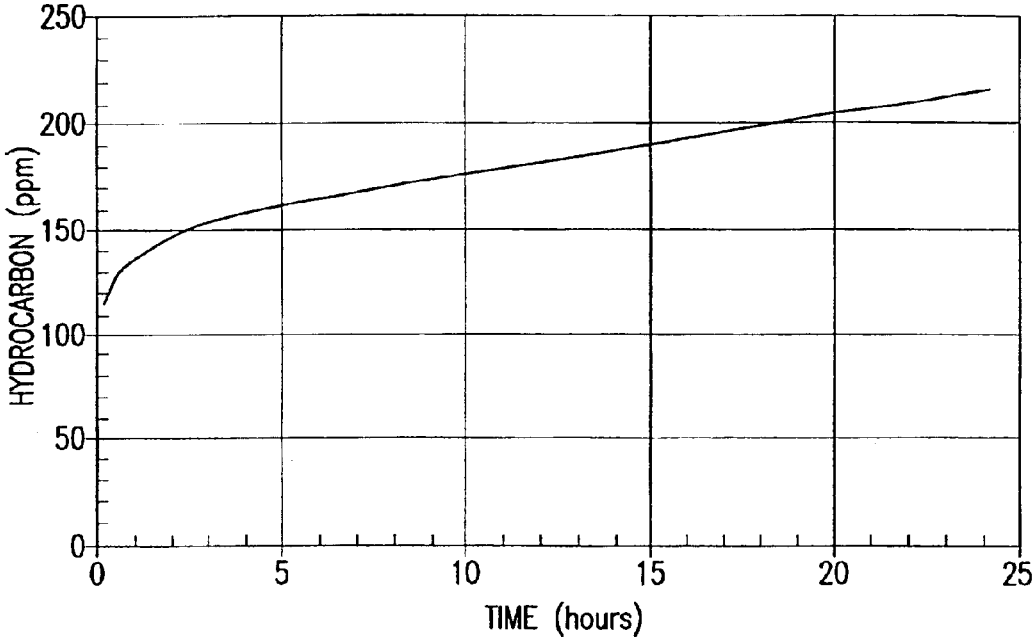
FIGS. 4–7 are graphical depictions of the amount of the hydrocarbon appearing in the extraction fluid as a function of time for each of Examples 1–4, respectively.
Figure 5:
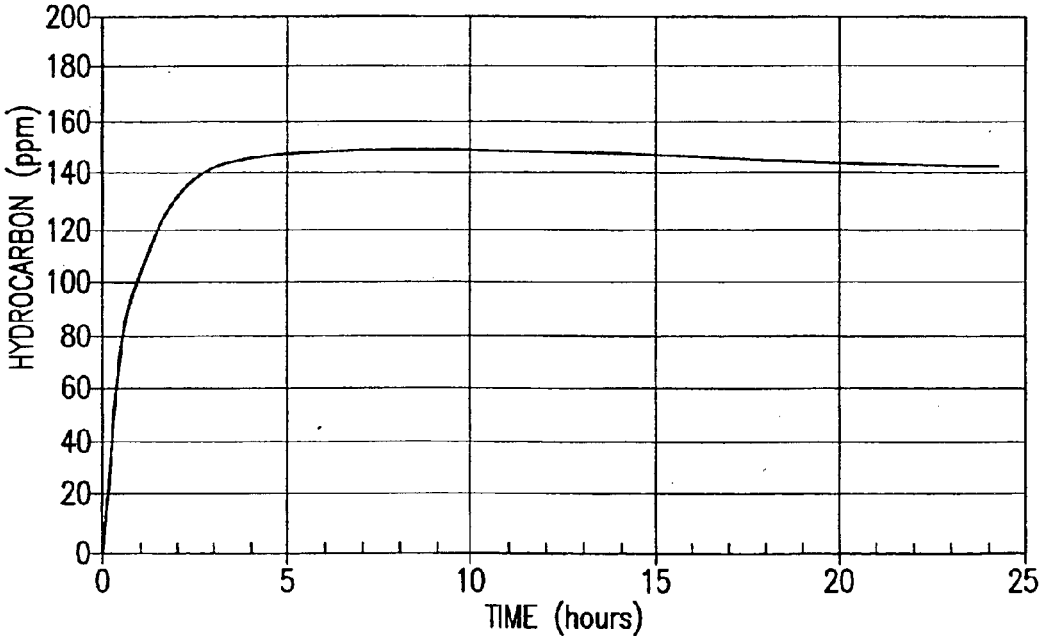
Figure 6:
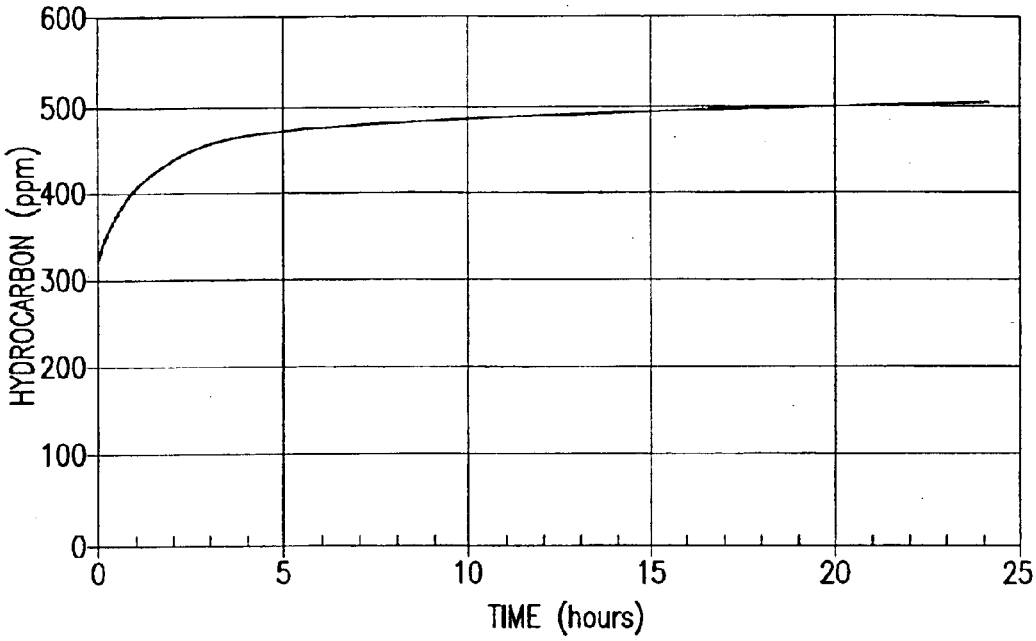
Figure 7:
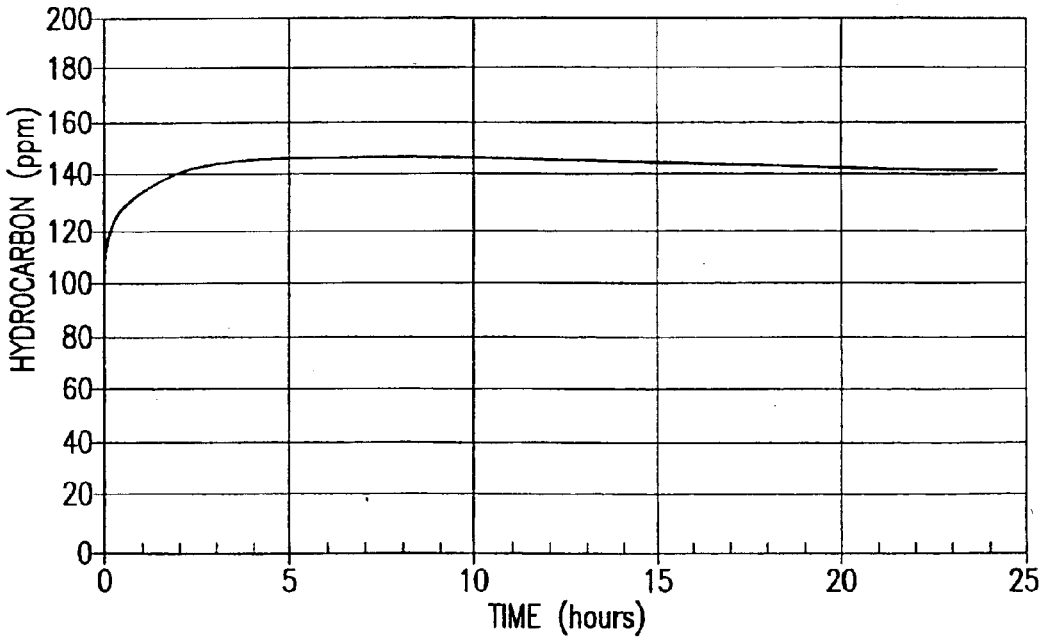

FIG. 3 illustrates a multiple chamber inflator assembly in general accord with the invention and generally designated by the reference numeral 310. The inflator 310 is an assembly that comprises a pressure vessel 312. The inflator assembly 310 includes a first initiator device 314*a* and a second initiator device 314*b*. Further, the inflator assembly 310 includes a bulkhead 315 or the like such as to divide the pressure vessel 312 such as to form a first chamber 316 and a second chamber 318. The inflator assembly 310 also includes a first diffuser assembly 320*a* and a second diffuser assembly 320*b*. The inflator 310 also has or includes opposed first and second end walls 322 and 323, respectively. Each of the end walls 322 and 323 includes an opening 324 and 325, respectively, wherethrough the respective of the initiator devices 314*a* and 314*b* is attached in sealing relation, such as described above.

In the illustrated static or at rest condition or state, each of the first and second chambers 316 and 318, respectively, is closed. Similar to the inflator 310 described above, the first chamber 316 contains a solid material, designated by the reference numeral 326, and the second chamber 318 contains a solid material, designated by the reference numeral 328. Further, the first chamber 316 has fluid contents, designated by the reference numeral 330, and such as may desirably be in contact with the solid material 326 and the second chamber 318 has fluid contents, designated by the reference numeral 332, and such as may desirably be in contact with the solid material 328.

The first chamber 316 is closed and the fluid contents 330 thereof appropriately held therewithin from fluid communication with the diffuser assembly 320*a* by means of a closure 340*a* such as composed of a wall 342*a* with a burst or rupture disk 344*a*. The diffuser assembly 320*a* defines a diffuser chamber 350*a* and includes a plurality of diffuser orifices or outlet openings 352*a* for dispensing inflation gas from the inflator 210 into an associated inflatable airbag cushion (not shown).

Similarly, in the static state, the second chamber 318 is closed and the fluid contents 332 thereof appropriately held therewithin from fluid communication with the diffuser assembly 320*b* by means of a closure 340*b* such as composed of a wall 342*b* with a burst or rupture disk 344*b*. The diffuser assembly 320*b* defines a diffuser chamber 350*b* and includes a plurality of diffuser orifices or outlet openings 352*b* for dispensing inflation gas from the inflator 310 into an associated inflatable airbag cushion (not shown).

As will be appreciated, such multiple chamber inflator apparatus can be operated in various manners or fashions as may be desired for various particular applications. In addition, extraction fluids of either or both different composition or at different conditions (e.g., storage pressures) may be used in various of the chambers of such multiple chamber inflator apparatus. Further, the same or different substrate materials as well as the same or different hydrocarbon contained therewithin can be used or applied in the practice of the invention with multiple chamber inflator apparatus of the invention.

Thus, it is to understood and appreciated that the invention can desirably be practiced in conjunction with inflators of various configurations and wherein one or more chambers require or contain a hydrocarbon-containing inflation gas-producing mixture.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Examples 1–4

This series of examples was conducted to test the feasibility of extracting hydrocarbons from a substrate material employing an extraction fluid combination of nitrous oxide and carbon dioxide. These example and the conditions employed therein were not optimized and are not to be construed as the best or preferred mode of practicing the invention.

In each of these examples, an O-ring made of nitrile rubber was soaked in the particular hydrocarbon and at the conditions shown in TABLE 1, below. The O-ring had a mass of 0.244 grams, a volume of 0.197 cc and a surface area of 7.75 cc.

Note that in Examples 1, 2 and 4, the ethylene was at a sufficiently high pressure to result or be in a liquid form for the specified "soak." In Example 3, the soak was conducted at ambient pressure as the hydrocarbon (i.e., octane) is a liquid at those conditions.

The hydrocarbon-soaked O-ring in each of these examples was then subject to an extraction fluid composed of 25% $N_2O$ and 75% $CO_2$ at conditions also shown in TABLE 1.

TABLE 1

| Example | Hydrocarbon | Soak Conditions | Extraction Conditions |
|---|---|---|---|
| 1 | ethylene | 1000 psi @ 1 hr | 3000 psi @ 21° C. |
| 2 | ethylene | 500 psi @ 1 hr | 1500 psi @ 33° C. |
| 3 | octane | @ 48 hrs | 1500 psi @ 21° C. |
| 4 | ethylene | 500 psi @ 1 hr | 3000 psi @ 21° C. |

The amount of the respective hydrocarbon appearing in the extraction fluid was measured as a function of time by placing the respective soaked O-ring in a pressurized container and periodically withdrawing a small sample and analyzing the sample via FTIR analysis, as is generally known in the art, to determine the hydrocarbon content thereof. FIGS. 4–7 are graphical depictions of the amount of the hydrocarbon appearing in the extraction fluid as a function of time for each of Examples 1–4, respectively.

Results

FIGS. 4–7 show that the hydrocarbon content increased with time, in these examples and thus is indicative of the feasibility of forming a hydrocarbon mixture over time through application of the subject invention.

Comparative Example 1 and Examples 5–8

These tests were conducted to show the significance of the inclusion of hydrocarbon in the performance of a liquified nitrous oxide and carbon dioxide inflator. In these tests, a test inflator similar in design to the inflator shown in FIG. 1 was used except that for convenience the hydrocarbon (ethylene) was, in accordance with TABLE 2 below, added directly to the chamber contents and such as to form a mixture having the indicated equivalence ratios. In each of these tests, the chamber contained a 50/50 mixture of nitrous oxide and carbon dioxide.

TABLE 2

| Test | Added $C_2H_4$ (grams) | Equivalence Ratio |
|---|---|---|
| Comparative Example 1 | none | 0 |
| Example 5 | 0.5 | 0.08 |
| Example 6 | 1.03 | 0.16 |
| Example 7 | 1.54 | 0.24 |
| Example 8 | 2.03 | 0.32 |

Figure 8:
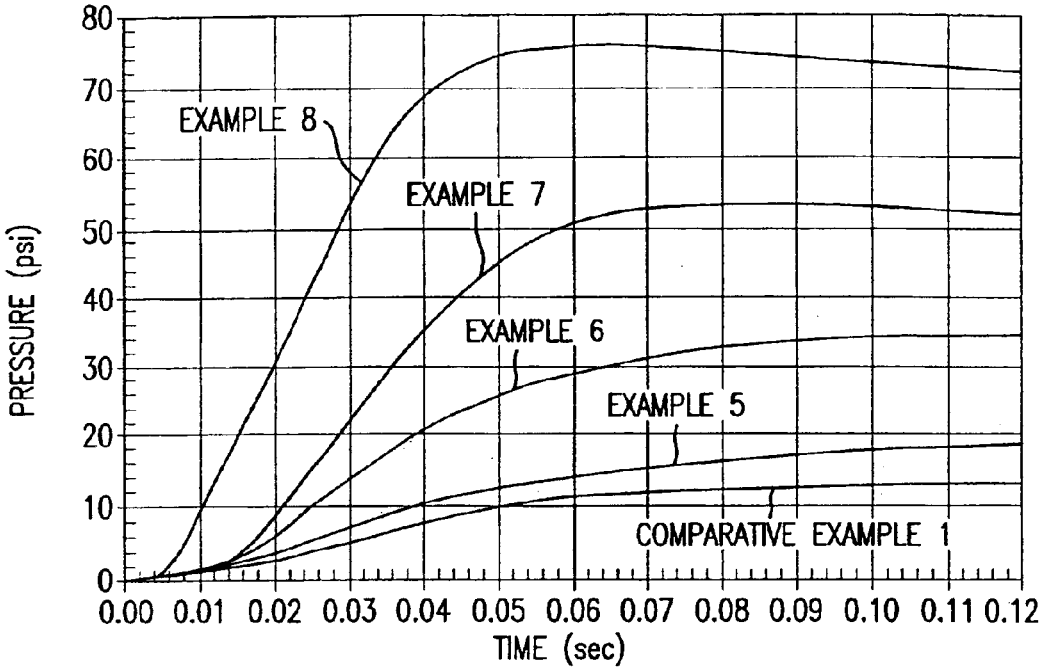
FIG. 8 is a graphical depiction of the tank pressure as a function of time performance realized with the test inflator assemblies of Examples 5–8 and Comparative Example 1.
Figure 9:
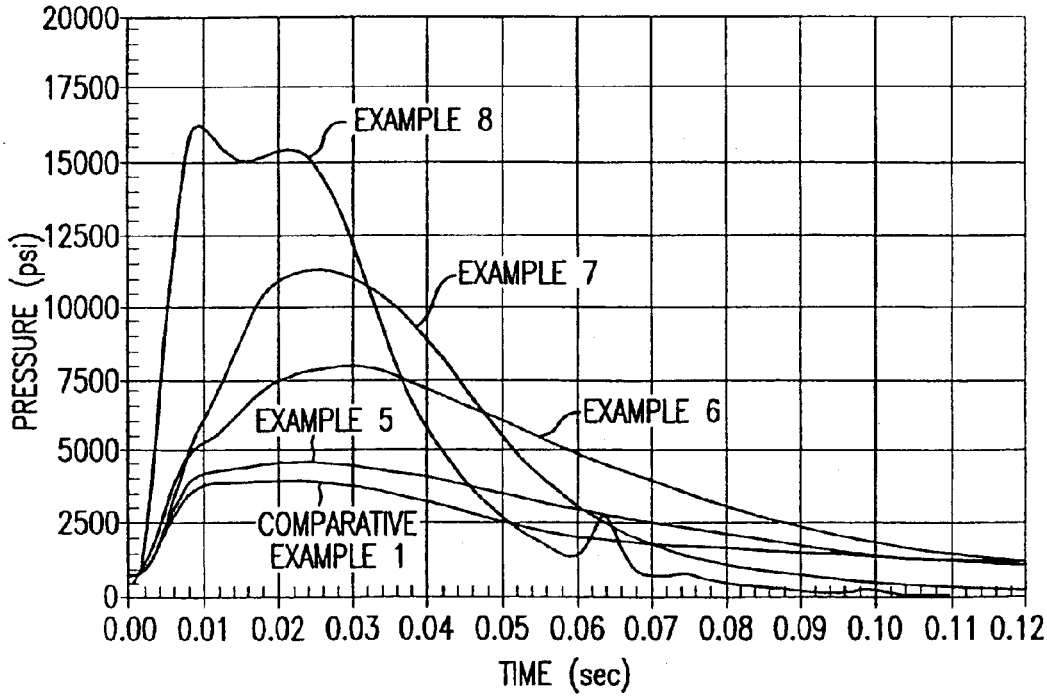
FIG. 9 is a graphical depiction of the internal pressure as a function of time performance realized with the test inflator assemblies of Examples 5–8 and Comparative Example 1.

FIGS. 8 and 9 illustrate the performance realized with the test inflators of Comparative Example 1 and Examples 5–8. More particularly, FIG. 8 is a graphical depiction of the tank pressure as a function of time performance and FIG. 9 is a graphical depiction of the internal pressure as a function of time performance, respectively, realized with these test inflator assemblies.

Results

These Examples highlight that the invention has applicability in the formation of hydrocarbon-containing inflation gas-producing mixtures for use in inflators based on or which apply combustion processing as well as those inflators which utilize or apply dissociation processing as herein described. In particular, FIG. 8 shows that higher performance as measured by tank pressure was obtained through increasing the hydrocarbon content of the inflation gas-producing mixture. FIG. 9 shows that the peak internal pressures realized within the test inflator devices progressively increased with increasing hydrocarbon content. Further, as thicker pressure vessels are typically employed to handle higher pressures and as thicker pressure vessels are typically heavier and more costly, these examples illustrate the need to be careful regarding the amount of hydrocarbon material in such inflation gas-producing mixtures.

Thus, the invention desirably provides a method for preparing and introducing a fluid mixture of fuel and oxidant into an inflator device which method is simpler, easier, and/or safer to practice than conventional methods. Further, the invention desirably provides inflator devices wherein such fuel and oxidant mixtures can be formed in situ and thus avoid at least some of the risks or dangers associated with the preparation, incorporation and use of such mixtures in inflator devices.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method comprising:

contacting a hydrocarbon-containing solid substrate material with an extraction fluid at conditions whereat the extraction fluid has a reduced density of at least 0.2 and a reduced density of no more than 2.0 wherein at least a portion of the hydrocarbon contained in the solid material is extracted into the extraction fluid to form an inflation gas-producing mixture.

2. The method of claim 1 wherein the extraction fluid includes at least one extraction medium selected from the group consisting of nitrous oxide, carbon dioxide, $SF_6$, xenon, ammnonia and mixtures thereof.

3. The method of claim 1 wherein the substrate material comprises a polysiloxane.

4. The method of claim 1 wherein the extraction fluid comprises nitrous oxide.

5. The method of claim 4 wherein the extraction fluid additionally comprises carbon dioxide.

6. The method of claim 5 wherein the extraction fluid contains:

at least 5 percent and no more than 90 percent nitrous oxide and at least 10 percent and no more than 95 percent carbon dioxide.

7. The method of claim 6 wherein the extraction fluid contains:

at least 15 percent and no more than 60 percent nitrous oxide and at least 40 percent and no more than 85 percent carbon dioxide.

8. The method of claim 5 wherein the inflation gas-producing mixture has an equivalence ratio of less than 0.25.

9. The method of claim 5 wherein the inflation gas-producing mixture has an equivalence ratio of at least 0.25 and no more than 1.4.

10. The method of claim 9 wherein the inflation gas-producing mixture has an equivalence ratio of at least 0.4 and no more than 0.7.

11. The method of claim 1 wherein the extraction fluid comprises carbon dioxide.

12. The method of claim 11 wherein the extraction fluid additionally comprises at least 5 percent and no more than 50 percent molecular oxygen.

13. The method of claim 11 wherein the inflation gas-producing mixture has an equivalence ratio of at least 0.25 and no more than 1.4.

14. The method of claim 13 wherein the inflation gas-producing mixture has an equivalence ratio of at least 0.4 and no more than 0.7.

15. The method of claim 1 wherein the extracted hydrocarbon is selected from the group consisting of paraffins, olefins, cycloparaffins, alcohols, esters, ethers and mixtures thereof.

16. The method of claim 15 wherein the extracted hydrocarbon is ethylene.

17. The method of claim 1 wherein the extracted hydrocarbon forms a miscible combination with the extraction fluid.

18. The method of claim 1 further comprising:

initiating reaction of the inflation gas-producing mixture to form an inflation gas.

19. The method of claim 18 wherein the substrate material is at least partially consumed in the reaction of the inflation gas-producing mixture.

20. The method of claim 1 wherein the substrate material additionally contains a quantity of $Kr^{85}$ and wherein the contacting step results in extraction from the substrate material of at least a leak detection quantity of $Kr^{85}$ by the extraction fluid.

21. A method for the in situ formation of an inflation gas-producing mixture, said method comprising:

contacting a hydrocarbon-containing substrate material with an extraction fluid containing at least one extraction medium selected from the group consisting of nitrous oxide, carbon dioxide, and mixtures thereof and at conditions whereat the extraction fluid has a reduced density of at least 0.2 and a reduced density of no more than 2.0 wherein at least a portion of the hydrocarbon contained in the solid material is extracted into the extraction fluid to form the inflation gas-producing mixture.

22. The method of claim 21 wherein the extraction fluid contains:

at least 5 percent and no more than 90 percent nitrous oxide and at least 10 percent and no more than 95 percent carbon dioxide.

23. The method of claim 22 wherein the extraction fluid contains:

at least 15 percent and no more than 60 percent nitrous oxide and at least 40 percent and no more than 85 percent carbon dioxide.

24. The method of claim 21 wherein the inflation gas-producing mixture has an equivalence ratio of less than 0.25.

25. An inflation gas-providing device wherein a mixture including a hydrocarbon material and an oxygen-containing material react to provide inflation gas, the gas-providing device comprising:

a chamber having contents including a hydrocarbon-containing solid substrate material and an extraction fluid at conditions whereat the extraction fluid has a reduced density of at least 0.2 and a reduced density of no more than 2.0 and wherein at least a portion of the hydrocarbon contained in the substrate material is extracted into the extraction fluid to form an inflation gas-producing mixture.

26. The device of claim 25 wherein the extraction fluid includes at least one extraction medium selected from the group consisting of nitrous oxide, carbon dioxide, $SF_6$, xenon, ammonia and mixtures thereof.

27. The device of claim 25 wherein the substrate material comprises a polysiloxane.

28. The device of claim 25 wherein the extraction fluid comprises nitrous oxide.

29. The device of claim 28 wherein the extraction fluid additionally comprises carbon dioxide.

30. The device of claim 29 wherein the extraction fluid contains:

at least 5 percent and no more than 90 percent nitrous oxide and at least 10 percent and no more than 95 percent carbon dioxide.

31. The device of claim 30 wherein the extraction fluid contains:

at least 15 percent and no more than 60 percent nitrous oxide and at least 40 percent and no more than 85 percent carbon dioxide.

32. The device of claim 29 wherein the inflation gas-producing mixture has an equivalence ratio of less than 0.25.

33. The device of claim 29 wherein the inflation gas-producing mixture has an equivalence ratio of at least 0.25 and no more than 1.4.

34. The device of claim 33 wherein the inflation gas-producing mixture has an equivalence ratio of at least 0.4 and no more than 0.7.

35. The device of claim 25 wherein the extraction fluid comprises carbon dioxide.

36. The device of claim 35 wherein the extraction fluid additionally comprises at least 5 percent and no more than 50 percent molecular oxygen.

37. The device of claim 35 wherein the inflation gas-producing mixture has an equivalence ratio of at least 0.25 and no more than 1.4.

38. The device of claim 37 wherein the inflation gas-producing mixture has an equivalence ratio of at least 0.4 and no more than 0.7.

39. The device of claim 25 wherein the hydrocarbon-containing solid substrate material includes at least one hydrocarbon is selected from the group consisting of paraffins, olefins, cycloparaffins, alcohols, esters, ethers and mixtures thereof.

40. The device of claim 25 wherein the substrate material includes the hydrocarbon ethylene.

41. The device of claim 25 additionally comprising an initiator device which upon actuation initiates reaction of the inflation gas-producing mixture.

42. The device of claim 41 wherein the substrate material is at least partially consumable upon reaction of the inflation gas-producing mixture.

43. The device of claim 25 wherein the substrate material additionally contains a quantity of $Kr^{85}$ and wherein at least a leak detection quantity of $Kr^{85}$ is extracted into the inflation gas-producing mixture.

* * * * *